US006543415B1

(12) United States Patent
Pursifull et al.

(10) Patent No.: US 6,543,415 B1
(45) Date of Patent: Apr. 8, 2003

(54) THROTTLE MISWIRE DETECTION

(75) Inventors: Ross Pursifull, Dearborn, MI (US); Chang Yang, Farmington Hills, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 10/237,752

(22) Filed: Sep. 9, 2002

(51) Int. Cl.[7] ..... F02D 1/00
(52) U.S. Cl. ..... 123/396; 123/399
(58) Field of Search ..... 123/399, 396; 73/118.1

(56) References Cited

U.S. PATENT DOCUMENTS 4,448,033 A 5/1984 Briccetti
5,384,495 A 1/1995 Waggamon et al.
5,537,855 A * 7/1996 Hunninghaus et al. ..... 73/35.05
5,673,668 A 10/1997 Pallett et al.
5,678,005 A 10/1997 Taylor
5,822,706 A 10/1998 Pfeufer et al.
5,950,597 A 9/1999 Kamio et al.
6,098,594 A * 8/2000 Kowatari et al. ..... 123/399
6,237,401 B1 5/2001 Hachn et al.
6,276,332 B1 * 8/2001 Storhok et al. ..... 123/397
6,345,604 B1 * 2/2002 Ahrns et al. ..... 123/398
6,378,493 B1 * 4/2002 Pursifull et al. ..... 123/399
6,393,350 B1 * 5/2002 Light et al. ..... 701/54
6,397,816 B1 * 6/2002 Pursifull ..... 123/399
6,442,472 B1 * 8/2002 Vivek et al. ..... 701/110

* cited by examiner

*Primary Examiner*—John Kwon
(74) *Attorney, Agent, or Firm*—Brinks Hofer Gilson & Lione

(57) ABSTRACT

A throttle miswire detection system including a powertrain control module (PCM) coupled to a throttle actuator and a pair of throttle plate position sensors. In detecting miswires, the PCM sets the throttle plate to a default position in which a default position value is measured by the position sensors. The PCM then sets the throttle plate to a closed position in which a closed position value is measured by the position sensors. After recording the receiving measurements, the PCM computes a negative slope sensor difference and a positive slope sensor difference. The PCM calculates a slope ratio consisting of the positive slope sensor difference divided by the negative slope sensor difference. If the slope values or slope ratio are not within prescribed limits, then the PCM deactivates the throttle actuator.

16 Claims, 6 Drawing Sheets

THROTTLE MISWIRE DETECTION

FIELD OF THE INVENTION

The present invention relates to motor vehicle electronic throttle control, and more particularly, to a system for detecting miswires that may adversely affect the performance of the electronic throttle.

BACKGROUND AND SUMMARY OF THE INVENTION

Previous motor vehicle throttle controls operate via a mechanical linkage between the accelerator pedal and the throttle body such that a throttle plate is rotated in concert with the movement of the accelerator cable. This method includes biasing for defaults the linkage to a default operating position consistent with regulations. Despite the simplicity and success of the mechanical throttle controls, the design was not adaptable to current automotive designs that emphasize reduced weight, responsiveness to varying travel conditions, and improved fuel economy.

Electronic throttle controls provide an alternative throttle control mechanism that improves the efficiency of air introduction into the cylinder. Generally, an electronic throttle includes a throttle plate, a throttle actuator, and a number of microprocessors and sensors for regulating the flow of air via the throttle valve. In particular, position sensors are utilized to determine the angle of the throttle plate, while a processor can cause the adjustment of the throttle plate angle in response to an increase or decrease in demand for air. In a typical throttle system, the electronic throttle is coupled to a powertrain control module (PCM).

Many PCM's employ various means to assure against any electronic malfunction or misread on the part of the electronic throttle. One method of assurance is to utilize redundant sensors, whereby more than one sensor responds to a particular condition so that the failure of a single sensor or an electronic component does not induce a throttle position greater than driver demand. More hardware, such as a redundant PCM, can be added to the throttle controls. However, the proliferation of components only increases the cost of throttle control, and by itself, cannot solve all the problems associated with throttle control.

Following the current trends in electronic throttle designs, a sensor malfunction would be overcome by utilizing a signal from its redundant counterpart. Redundancy thus allows the throttle control to operate. However, in the case of an electronic throttle control miswire, it is not desirable for the electronic throttle to continue operation. If there is a wiring error between the PCM and the electronic throttle control, the electronic throttle may perform, but it likely will not perform according to its design intent. That is, the PCM may be responsive to driver intent, but the electronic throttle would be incapable of receiving a command signal indicative of that intent.

Accordingly, the present invention includes a systematic method of detecting an electronic throttle control miswire and disabling the throttle control in response thereto. In particular, the present invention is an electronic throttle miswire detection system having as its main components an electronic throttle including a throttle plate, a throttle actuator, a first and second position sensor, and a PCM coupled to the throttle actuator and the respective sensors. The sensors, the throttle actuator, and the PCM cooperate to control the angular position of the throttle plate.

In detecting miswires, the PCM sets the throttle plate to a default position in which a default position value is measured by the position sensors. The PCM then sets the throttle plate to a closed position in which a closed position value is measured by the position sensors. After recording the receiving measurements, the PCM computes a negative slope sensor difference consisting of the default position value as measured by the first throttle position sensor less the closed position value as measured by the first throttle position sensor. The value of the negative slope sensor difference is then inverted, or multiplied by negative one. Similarly, the PCM computes a positive slope sensor difference consisting of the default position value as measured by the second throttle position sensor less the closed position value as measured by the second throttle position sensor.

If either the positive slope sensor difference or the negative slope sensor difference is less than zero, the PCM deactivates the throttle actuator. After normalizing the respective sensor difference values, the PCM calculates a slope ratio consisting of the positive slope sensor difference divided by the negative slope sensor difference. If the slope ratio falls within a prescribed safe harbor, then the PCM continues normal operation. If the slope ratio is either below or above the safe harbor, then the PCM deactivates the throttle actuator.

DETAILED DESCRIPTION OF THE PREFERRED EMBODIMENT

The present invention consists of a system for detecting an electronic throttle control miswire and disabling the throttle control is response thereto. In particular, the present invention is an electronic throttle miswire detection system 10 having as its main components an electronic throttle 11 coupled to a PCM 12. The PCM 12 controls the operation of the electronic throttle 11, thereby determining the mass rate of fresh air that is introduced into the combustion process.

Figure 1:
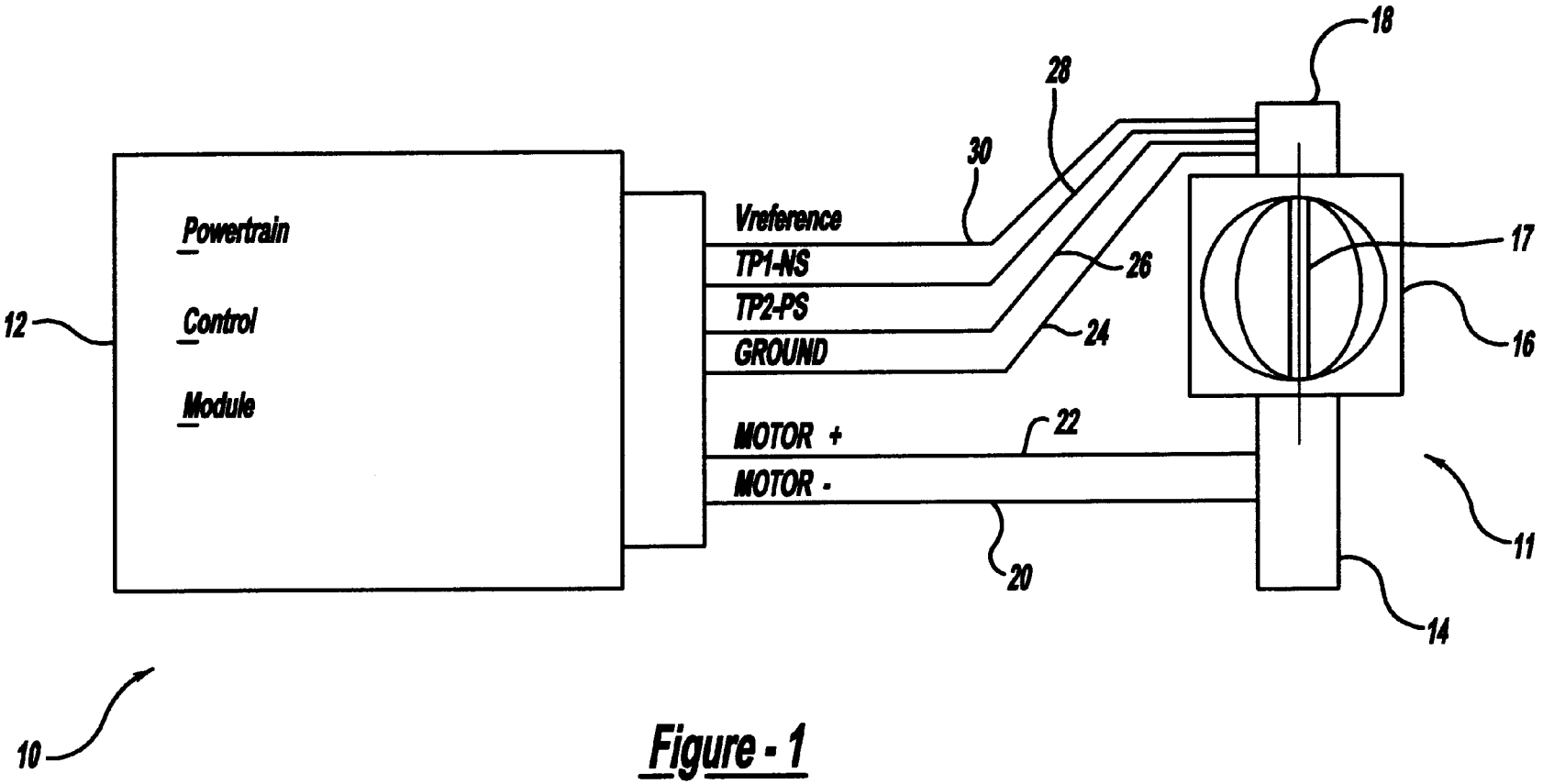
FIG. 1 is a schematic block diagram of the electronic throttle miswire detection system of the present invention.

As shown in FIG. 1, the electronic throttle 11 consists of a throttle actuator 14, which is adapted to rotate of throttle plate 17 disposed within a throttle valve 16. The throttle plate 17 is arranged such that it is rotatable over a range of 93°, preferably from a closed position determined to be 7° to a full-open position determined to be 100°. For purposes of the present invention, the throttle plate 17 may also be located at a default position, which is approximately 7.5° above the closed position, or approximately 14.5°. The angular position of the throttle plate 17 is measured by a dual throttle position sensor 18, which consists of at least a first throttle position sensor and a second throttle position sensor. For purposes of this description, the first and second throttle position sensors are located within a single dual throttle position sensor 18, although they may operate remotely in alternate embodiments.

The electronic throttle 11 is coupled to the PCM 12 via a set of wires 20, 22, 24, 26, 28, 30. In a typical arrangement, there may be as many as 120 wires that transmit signals between the electronic throttle 11 and the PCM 12. However, for purposes of this invention, the only six wires that are considered are those that are most likely to result in miswiring. In particular, the PCM 12 is coupled to the throttle actuator 14 via the "Motor−" wire 20 and "Motor+" wire 22. The PCM 12 is coupled to the dual position sensor 18 via the TP1-NS wire 28 and the TP2-PS wire 26.

The TP1-NS wire 28 transmits a signal indicative of the position of the throttle plate 17 as measured by the first throttle position sensor; and the TP2-PS wire 26 transmits a signal indicative of the position of the throttle plate 17 as measured by the second throttle position sensor. The respective outputs of the dual position sensor 18 are quantified with respect to a reference voltage, which is measured relative to the voltage supplied by the Vreference wire 30 and the ground wire 24, also coupled to the dual position sensor 18. Accordingly, for any angular position of the throttle plate 17, each of the first and second throttle position sensors will register an output voltage as a percentage of the reference voltage, as discussed further herein. Properly wired, the PCM 12 and electronic throttle 11 will cooperatively regulate the position of the throttle plate 17 for efficient vehicle performance.

Figure 2A:
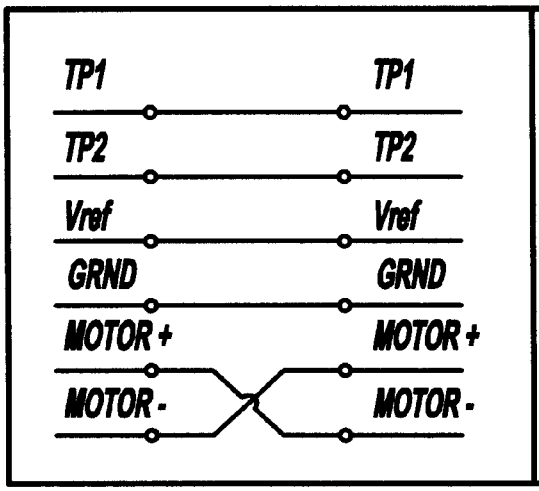
FIG. 2*a* is a schematic diagram showing a common electronic throttle miswire.
Figure 2B:
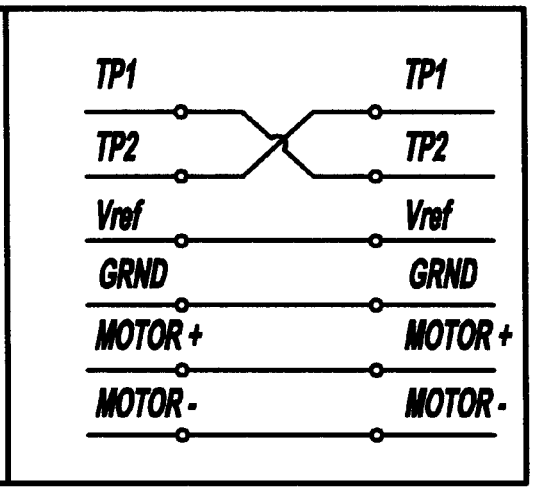
FIG. 2*b* is a schematic diagram showing a common electronic throttle miswire.
Figure 2C:
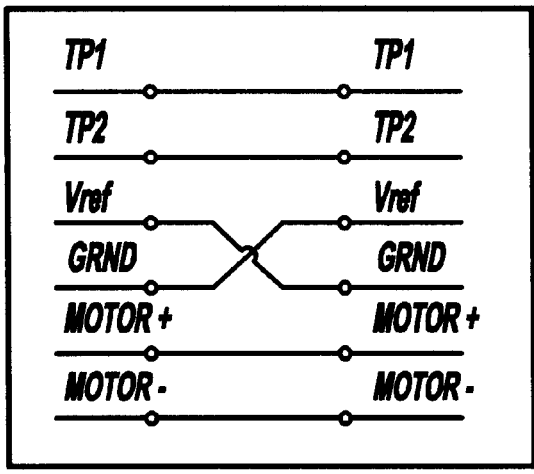
FIG. 2*c* is a schematic diagram showing a common electronic throttle miswire.
Figure 2D:
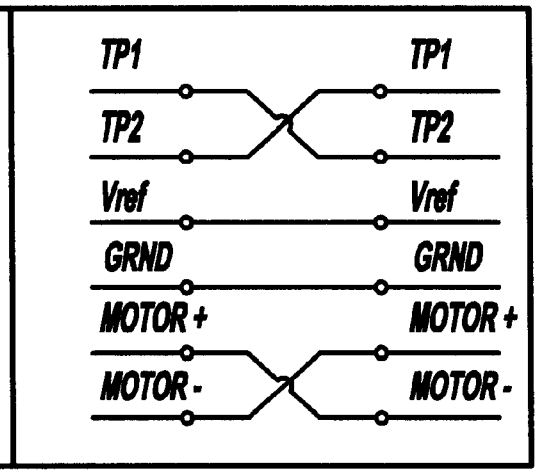
FIG. 2*d* is a schematic diagram showing a pair of common electronic throttle miswires.
Figure 2E:
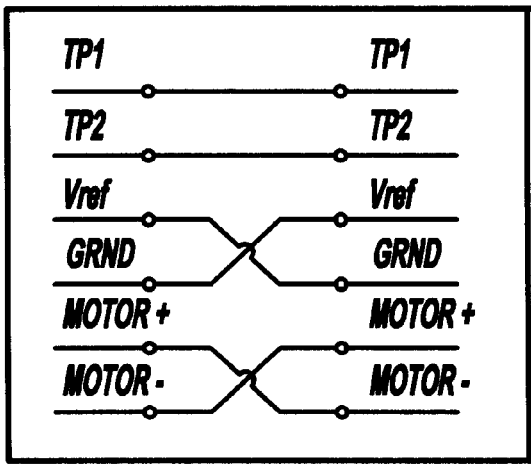
FIG. 2*e* is a schematic diagram showing a second pair of common electronic throttle miswires.
Figure 2F:
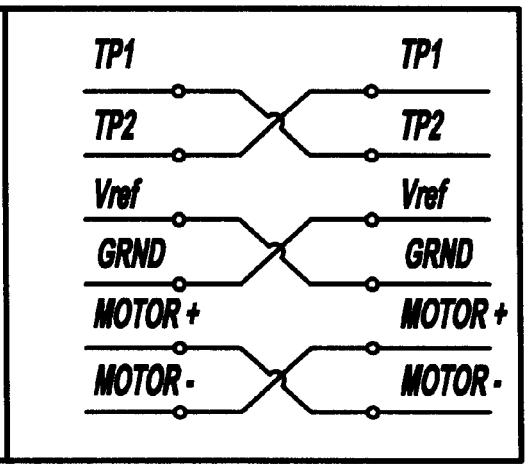
FIG. 2*f* is a schematic diagram showing three concurrent electronic throttle miswires.

However, as shown in FIGS. 2*a*, 2*b*, 2*c*, 2*d*, 2*e*, 2*f*, 2*g* and 2*h*, it is possible for miswires to occur that, while not rendering the PCM 12 or electronic throttle 11 inactive, might hamper the performance of the vehicle. For example, FIG. 2*a* schematically represents a "Motor−" wire 20 and "Motor+" wire 22 switch. FIG. 2*b* depicts a TP2 wire 26 and TP1 wire 28 switch. FIG. 2*c* shows a Vreference wire 30 and ground wire 24 switch. FIG. 2*f* depicts a triple-switch in which the "Motor−" wire 20 and "Motor+" wire 22, the TP2 wire 26 and TP1 wire 28, and the Vreference wire 30 and ground wire 24 are respectively switched. Collectively, the miswires depicted in FIGS. 2*a*, 2*b*, 2*c*, and 2*f* may be referred to as asymmetrical miswires, the import of which is discussed further herein.

Figure 2G:
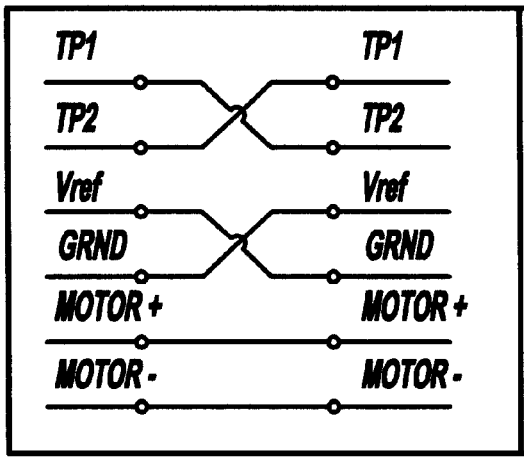
FIG. 2*g* is a schematic diagram showing a third pair of common electronic throttle miswires.

FIGS. 2*d*, 2*e*, and 2*g* show a set of double-switch scenarios. In FIG. 2*d*, the "Motor−" wire 20 and "Motor+" wire 22 are switched; and the TP2 wire 26 and TP1 wire 28 are switched. In FIG. 2*e*, the "Motor−" wire 20 and "Motor+" wire 22 are switched and so are the Vreference wire 30 and ground wire 24. In FIG. 2*g*, the TP2 wire 26 and TP1 wire 28 and the Vreference wire 30 and ground wire 24 are respectively switched. The miswires depicted in the foregoing Figures may be referred to as symmetrical miswires, the import of which is discussed further herein.

Figure 2H:
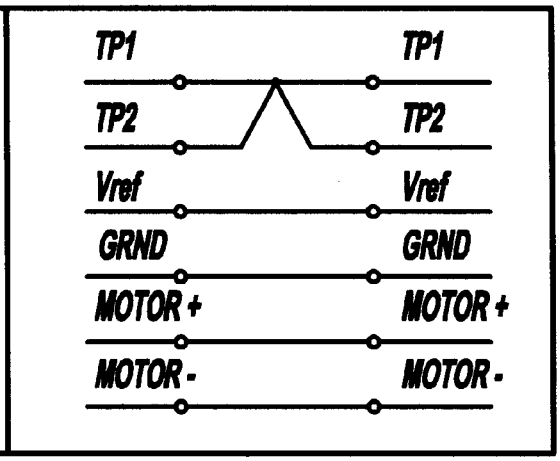
FIG. 2*h* is a schematic diagram showing a short circuit within the electronic throttle wiring.

FIG. 2*h* is a special case of a throttle miswire in which the TP2 wire 26 and TP1 wire 28 are shorted.

Figure 3:
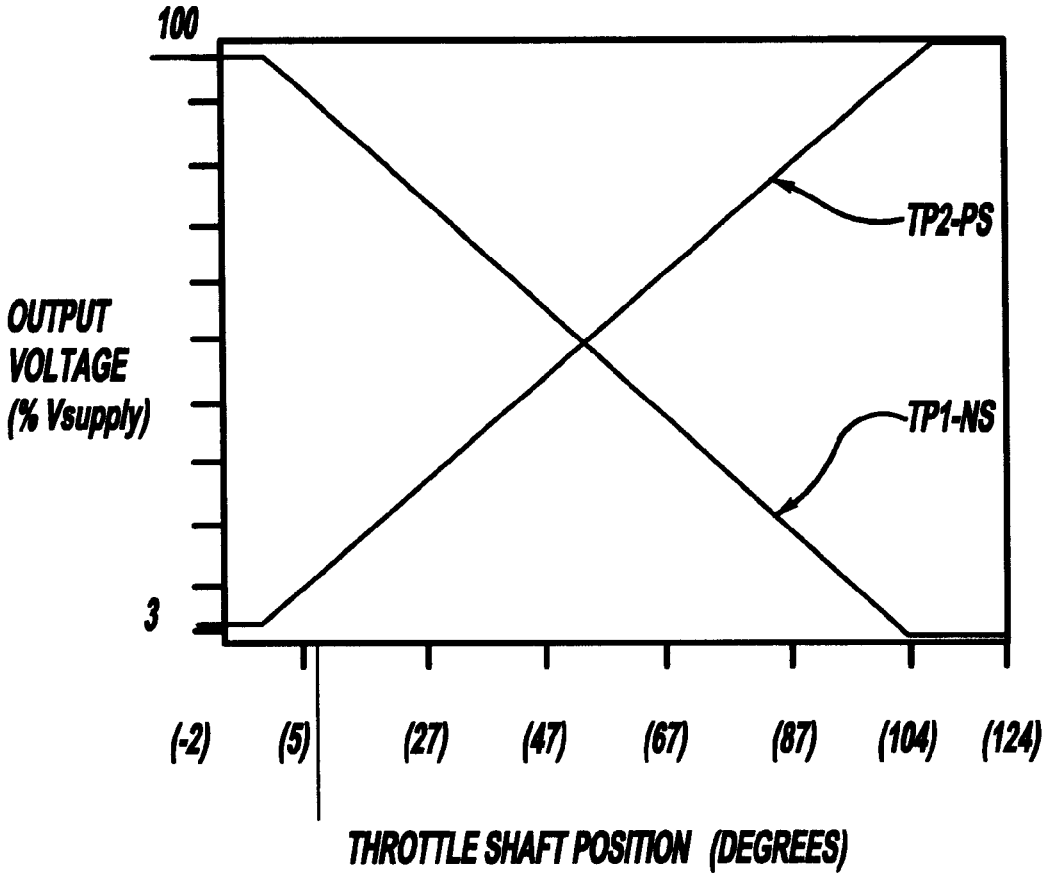
FIG. 3 is a graphical representation of a symmetrical relationship between throttle plate angle and output voltage.

FIG. 3 is a graphical representation of a relationship between the throttle plate 17 angle and the output voltage recorded by the first and second sensors of the dual sensor 18. The output of the first sensor is denoted TP1-NS, where the suffix NS refers to the negative slope of the graph. The output of the second sensor is denoted TP2-PS, where the suffix PS refers to the positive slope of the graph.

Figure 4:
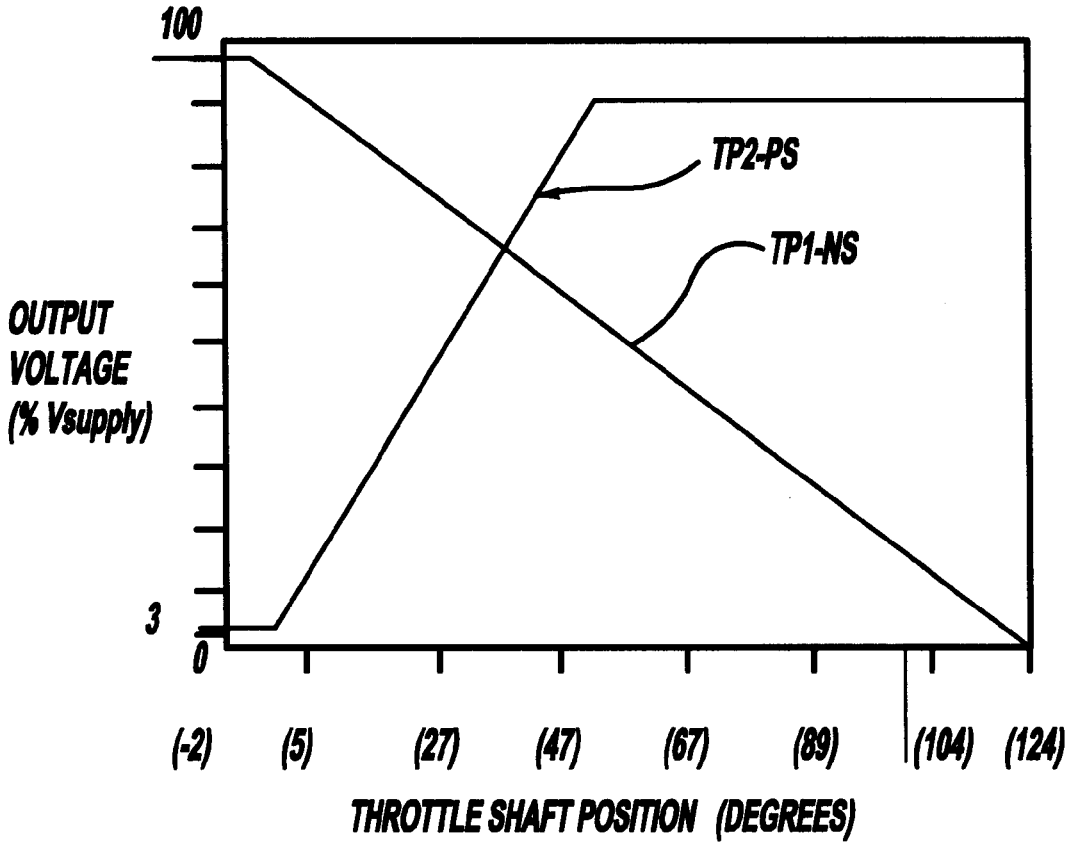
FIG. 4 is a graphical representation of an asymmetrical relationship between throttle plate angle and output voltage.

FIG. 4 is a graphical representation of an a second relationship between the throttle plate 17 angle and the output voltage recorded by the first and second sensors of the dual sensor 18. Again, the output of the first sensor is denoted TP1-NS, where the suffix NS refers to the negative slope of the graph. The output of the second sensor is denoted TP2-PS, where the suffix PS refers to the positive slope of the graph.

The graphs shown in FIGS. 3 and 4 are representative of different ways of processing the outputs of the first and second sensors with respect to throttle plate 17 angle. The electronic throttle 11 may be determinative of whether the data is processed in accordance with FIG. 3 or FIG. 4. As noted previously, the common miswirings occur in symmetrical and asymmetrical fashion, depending upon the number of sets of crossed wires. Accordingly, it is a feature of the present invention that both processes illustrated in FIGS. 3 and 4 are utilized in order to detect both types of miswirings.

Figure 5:
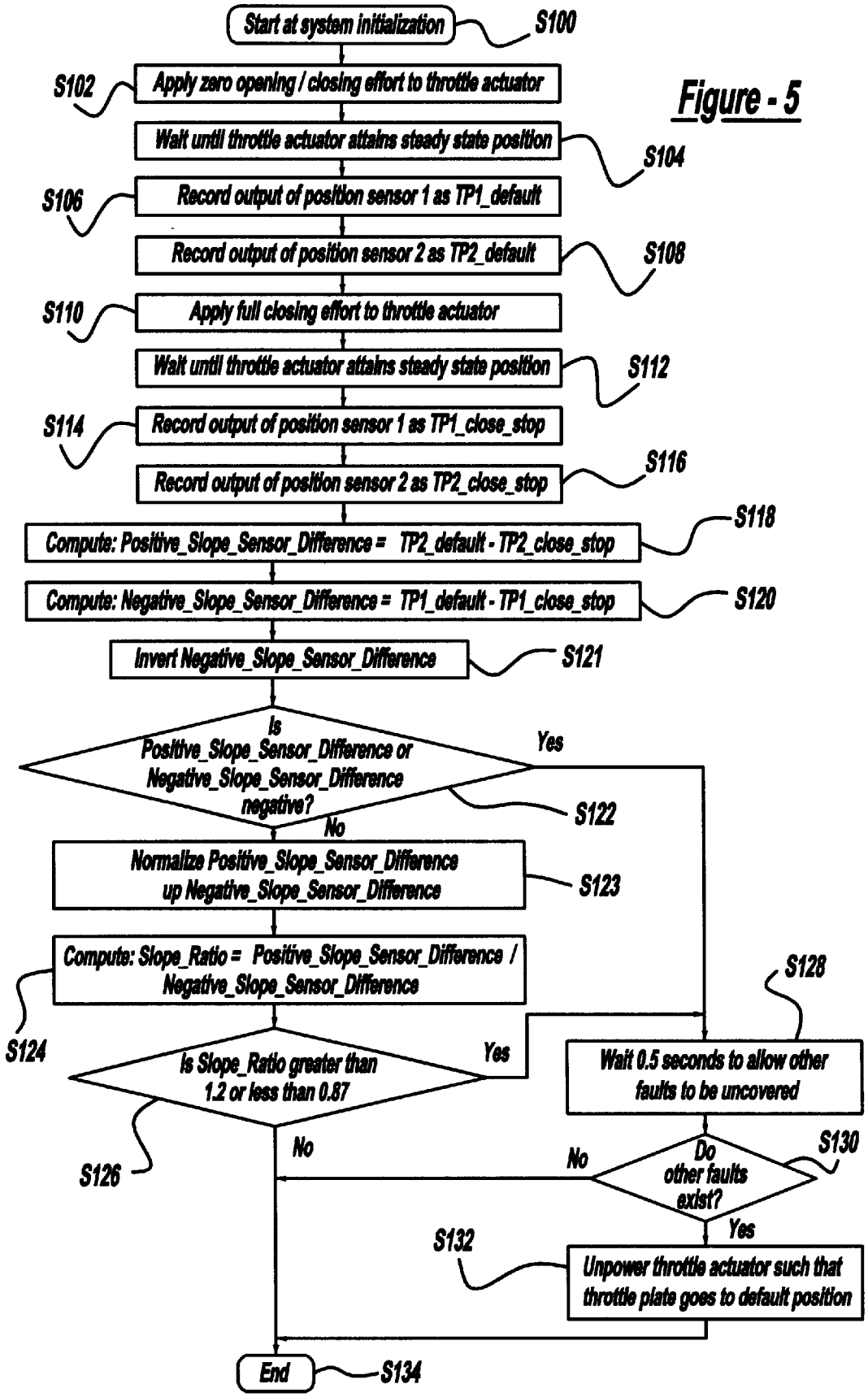
FIG. 5 is a flow chart depicting the miswire detection method according to the present invention.

FIG. 5 is a flowchart describing the method by which the PCM 12 detects miswirings. Upon initialization, step S100, the PCM 12 instructs the throttle actuator 14 to open or close the throttle plate 17 as shown in step S102. The PCM 12 then delays a prescribed time while the throttle actuator 14 attains a steady state or a default position, as shown in step S104.

Once the throttle actuator 14 is in a steady state, then the PCM 12 proceeds to step S106 in which it records the output of the first position sensor in the default position, denoted TP1_default. In step S108, the PCM 12 records the output of the second position sensor in the default position, denoted TP2_default. In step S110, the PCM 12 instructs the throttle actuator 14 to close the throttle plate 17 until the throttle actuator 14 has attained a steady state as shown in step S112. Once the throttle actuator 14 is in a steady state, then the PCM 12 proceeds to step S114 in which it records the output of the first position sensor in the closed position, denoted TP1_close_stop. In step S116, the PCM 12 records the output of the second position sensor in the closed position, denoted TP2_close_stop.

In steps S118 and S120, the PCM 12 computes the quantities denoted the Positive Slope Sensor Difference (PSSD) and the Negative Slope Sensor Difference (NSSD), respectively. As shown, the PSSD is the change in voltage readings between the default and closed positions of the second position sensor, or PSSD=TP2_default−TP2_close_stop. Similarly, the NSSD is the change in voltage readings between the default and closed positions of the first position sensor, or NSSD=TP1_default−TP1_close_stop. In step S121, the PCM 12 inverts the value of the NSSD by multiplying the NSSD by negative one. Given both the PSSD and the NSSD calculated above, the PCM 12 can systematically check for any miswirings, of either the symmetrical or asymmetrical variety.

In step S122, the PCM 12 inquires as to whether either the PSSD or the NSSD is less than zero. As noted, in step S121 the NSSD was inverted. As such, an NSSD value of less than zero in step S122 implies that the NSSD as calculated in step S120 was greater than zero, thereby indicating a fault in the throttle wiring.

A value of less than zero is indicative of an asymmetrical miswire, consisting generally of a type of miswiring shown in FIGS. 2*a*, 2*b*, 2*c*, and 2*f*. If either of the PSSD or the NSSD is negative, then the PCM 12 proceeds to step S128, which requests a 0.5 second delay to allow for the uncovering of ancillary faults which may render this test invalid. For example, faults such as a position sensor output out of range, an open throttle motor circuit, or a stuck throttle may be detected. Following the delay, the PCM 12 inquires as to whether any additional faults exist, as shown in step S130. If no other faults are detected, then in step S132, the PCM 12 deactivates the throttle actuator 14 such that the throttle plate 17 returns to the default position. Step S134 represents the termination of the miswire detection system check.

Returning to step S122, if the PCM 12 does not calculate that one of the PSSD or the NSSD is less than zero, then the PCM 12 proceeds to step S123 in which it normalizes the PSSD and the NSSD. As shown in FIG. 4, the TP2-PS slope is twice that of the TP1-NS slope. Therefore, in normalizing the PSSD and the NSSD, the PCM 12 either multiplies the NSSD by 2 or divides the PSSD by 2.

Following normalization, the PCM 12 in step S124 computes the slope ratio of the sensor outputs, shown as: Slope_Ratio=PSSD/NSSD. In step S126, the PCM 12 inquires as to whether the slope ratio is within a prescribed safe harbor between 0.87 and 1.2. A value of the slope ratio outside the safe harbor is indicative of a symmetrical miswire of the type shown in FIGS. 2*d*, 2*e*, and 2*g*.

If the slope ratio is either less than 0.87 or greater than 1.2, then the PCM 12 proceeds to step S128. As before, the PCM 12 executes a 0.5 second delay to uncover any ancillary faults such as a position sensor output out of range, an open throttle motor circuit, or a stuck throttle. Thereafter, the PCM 12 inquires as to whether any additional faults exist, as shown in step S130. If another fault, such as a faulty throttle position sensor, is detected, then in step S132, the PCM 12 deactivates the throttle actuator 14 such that the throttle plate 17 returns to the default position. The PCM 12 then completes the system check at step S134.

If the slope ratio is within the safe harbor between 0.87 and 1.2, then the PCM 12 proceeds to step S134, and the system check is complete.

As noted, the PCM 12 is capable of processing the voltage readings from the first and second position sensors as shown in FIGS. 3 and 4. However, because the TP_1 and TP_2 sensor curves shown FIG. 3 are symmetrical in nature, they are not useful in detecting symmetrical miswirings of the type shown in FIGS. 2*d*, 2*e*, and 2*g*. That is, the NSSD and PSSD would have the same absolute differences in voltage irrespective of the direction of their respective slopes. Therefore, a double miswire, as shown in FIG. 2*d*, would effectively cancel itself out such that both the NSSD and PSSD would have the same value as if the wiring were proper.

By way of comparison, the signal processing illustrated in FIG. 4 is capable of detecting both symmetrical and asymmetrical miswires, due to the asymmetrical nature of the TP_1 and TP_2 curves. Accordingly, the NSSD and the PSSD do not have the same absolute values independent of their respective orientation. As such, the signal processing shown in FIG. 4 enables the PCM 12 to detect symmetrical miswires.

In a preferred embodiment, the PCM 12 is adapted to utilize the signal processing method illustrated in FIG. 4 for detecting both symmetrical and asymmetrical miswires. Alternatively, the PCM 12 may utilize both types of signal processing to ensure redundant measurements of the NSSD and PSSD.

As described, the present invention consists of a system and associated method for detecting miswirings in a throttle control system. Advantageously, the present invention includes a mechanism for disabling the throttle actuator in the event of a miswire in order to ensure the efficiency and accuracy of the throttle control system.

What is claimed is:

1. An electronic throttle miswire detection system comprising:

an electronic throttle including a throttle plate, a throttle actuator, a first throttle position sensor, and a second position sensor; and a powertrain control module (PCM) coupled to the throttle actuator, the first throttle position sensor, and the second throttle position sensor, the PCM adapted to control an angular position of the throttle plate, the throttle plate adapted to maintain a default position in which a default position value is measurable by the first throttle position sensor and the second throttle position sensor, and the throttle plate further adapted to maintain a closed position in which a closed position value is measurable by the first throttle position sensor and the second throttle position sensor, wherein the PCM is further adapted to compute a negative slope sensor difference consisting of the default position value as measured by the first throttle position sensor less the closed position value as measured by the first throttle position sensor, the PCM further adapted to compute a positive slope sensor difference consisting of the default position value as measured by the second throttle position sensor less the closed position value as measured by the second throttle position sensor;

whereby, in response to a less than zero value for one of the positive slope sensor difference or the negative slope sensor difference, the PCM is adapted to deactivate the throttle actuator.

2. The electronic throttle miswire detection system of claim 1 wherein the PCM is further adapted to deactivate the throttle actuator in response to a slope ratio greater than 1.5, wherein the slope ratio consists of the positive slope sensor difference divided by the negative slope sensor difference.

3. The electronic throttle miswire detection system of claim 1 wherein the PCM is further adapted to deactivate the throttle actuator in response to a slope ratio greater than 1.2, wherein the slope ratio consists of the positive slope sensor difference divided by the negative slope sensor difference.

4. The electronic throttle miswire detection system of claim 1 wherein the PCM is further adapted to deactivate the throttle actuator in response to a slope ratio less than 0.75, wherein the slope ratio consists of the positive slope sensor difference divided by the negative slope sensor difference.

5. The electronic throttle miswire detection system of claim 1 wherein the PCM is further adapted to deactivate the throttle actuator in response to a slope ratio less than 0.8, wherein the slope ratio consists of the positive slope sensor difference divided by the negative slope sensor difference.

6. The electronic throttle miswire detection system of claim 1 wherein the PCM is further adapted to deactivate the throttle actuator in response to a slope ratio less than 0.87, wherein the slope ratio consists of the positive slope sensor difference divided by the negative slope sensor difference.

7. The electronic throttle miswire detection system of claim 1 wherein the PCM is further adapted to deactivate the throttle actuator in response to a slope ratio greater than 1.2, the PCM further adapted to deactivate the throttle actuator in response to a slope ratio less than 0.87, wherein the slope ratio consists of the positive slope sensor difference divided by the negative slope sensor difference.

8. A method of detecting miswire in an electronic throttle comprising the steps of:

recording a first default position of a throttle plate;

recording a first closed position of the throttle plate;

computing a negative slope difference consisting of the first default position less the first closed position;

deactivating a throttle actuator in response to a computed negative slope difference of less than zero.

9. The method of claim 8 further comprising the step of computing a positive slope difference consisting of a second default position less a second closed position.

10. The method of claim 9 further comprising the step of deactivating the throttle actuator in response to a computed positive slope difference of less than zero.

11. The method of claim 8 further comprising the steps of computing a positive slope difference consisting of a second default position less a second closed position and calculating a slope ratio consisting of the positive slope difference divided by the negative slope difference.

12. The method of claim 11 further comprising the step of deactivating the throttle actuator in response to a calculated slope ratio of greater than 1.5.

13. The method of claim 11 further comprising the step of deactivating the throttle actuator in response to a calculated slope ratio of greater than 1.2.

14. The method of claim 11 further comprising the step of deactivating the throttle actuator in response to a calculated slope ratio of less than 0.75.

15. The method of claim 11 further comprising the step of deactivating the throttle actuator in response to a calculated slope ratio of less than 0.8.

16. The method of claim 11 further comprising the step of deactivating the throttle actuator in response to a calculated slope ratio of less than 0.87.

* * * * *